US007665958B2

(12) United States Patent
Khanin et al.

(10) Patent No.: US 7,665,958 B2
(45) **Date of Patent: *Feb. 23, 2010**

(54) HEAT ACCUMULATION SEGMENT

(75) Inventors: Alexander Khanin, Moscow (RU); Edouard Sloutski, Moscow (RU)

(73) Assignee: Alstom Technology Ltd., Baden (CH)

( * ) Notice: Subject to any disclaimer, the term of this patent is extended or adjusted under 35 U.S.C. 154(b) by 148 days.

This patent is subject to a terminal disclaimer.

(21) Appl. No.: 11/860,099

(22) Filed: Sep. 24, 2007

(65) Prior Publication Data

US 2008/0050225 A1 Feb. 28, 2008

Related U.S. Application Data

(63) Continuation of application No. PCT/EP2006/060900, filed on Mar. 21, 2006.

(30) Foreign Application Priority Data

Mar. 24, 2005 (DE) ..... 10 2005 013 796

(51) Int. Cl.
*F01D 25/26* (2006.01)

(52) U.S. Cl. ..... 415/134; 415/173.1; 415/213.1

(58) Field of Classification Search ..... 415/114, 415/134, 173.1, 173.6, 199.5, 213.1; 416/95
See application file for complete search history.

(56) References Cited

U.S. PATENT DOCUMENTS 3,362,160 A * 1/1968 Bourgeois ..... 60/805
3,391,904 A * 7/1968 Albert et al. ..... 415/173.1
3,558,237 A * 1/1971 Wall, Jr. ..... 415/115
3,583,824 A * 6/1971 Smuland et al. ..... 415/117
3,825,364 A * 7/1974 Halila et al. ..... 415/116
3,864,056 A 2/1975 Gabriel et al.
3,892,497 A * 7/1975 Gunderlock et al. ..... 415/134
4,222,707 A * 9/1980 Drouet et al. ..... 415/116
4,679,981 A * 7/1987 Guibert et al. ..... 415/116
5,071,313 A * 12/1991 Nichols ..... 415/134
5,161,944 A * 11/1992 Wood ..... 415/173.3
5,165,847 A * 11/1992 Proctor et al. ..... 415/115
5,169,287 A * 12/1992 Proctor et al. ..... 415/115

(Continued)

FOREIGN PATENT DOCUMENTS

DE 2432092 A1 2/1975

(Continued)

*Primary Examiner*—Edward Look
*Assistant Examiner*—Aaron R Eastman
(74) *Attorney, Agent, or Firm*—Volpe & Koenig, P.C.

(57) ABSTRACT

A heat accumulation segment for local separation of a flow duct inside a turbo engine, from a stator housing that radially surrounds the flow duct is provided. The heat accumulation segment includes two axially opposed joining contoured elements that are engagable with two components that are axially adjacent along the flow duct. A first one of the two joining contoured elements has a radially oriented recess with a contoured surface against which a securing pin having an external contour complementary to the contoured surface acts radially under force action from a component that adjoins the first joining contoured element. The first joining contoured element has a collar portion having radially upper and lower collar surfaces, and the collar portion is connected within a counter-contoured receiving contoured element in the axially adjacent component by a joining force that acts between the securing pin and the conical contoured surface.

18 Claims, 3 Drawing Sheets

U.S. PATENT DOCUMENTS

| | | | | | |
|---|---|---|---|---|---|
| 5,593,277 | A | * | 1/1997 | Proctor et al. | 415/173.1 |
| 5,772,400 | A | * | 6/1998 | Pellow | 415/173.1 |
| 5,964,575 | A | * | 10/1999 | Marey | 415/115 |
| 5,993,150 | A | * | 11/1999 | Liotta et al. | 415/115 |
| 6,139,257 | A | * | 10/2000 | Proctor et al. | 415/115 |
| 6,183,192 | B1 | * | 2/2001 | Tressler et al. | 415/115 |
| 6,200,091 | B1 | * | 3/2001 | Bromann et al. | 415/173.1 |
| 6,412,149 | B1 | * | 7/2002 | Overberg | 24/455 |
| 6,514,041 | B1 | | 2/2003 | Matheny et al. | |
| 6,575,697 | B1 | | 6/2003 | Arilla et al. | |
| 6,666,645 | B1 | * | 12/2003 | Arilla et al. | 415/116 |
| 2003/0215328 | A1 | | 11/2003 | McGrath et al. | |
| 2004/0018081 | A1 | * | 1/2004 | Anderson et al. | 415/108 |
| 2006/0165518 | A1 | * | 7/2006 | Albers et al. | 415/173.1 |
| 2007/0031243 | A1 | * | 2/2007 | Ruthemeyer et al. | 415/134 |
| 2007/0231127 | A1 | * | 10/2007 | Durand et al. | 415/173.1 |
| 2008/0240915 | A1 | * | 10/2008 | Castel et al. | 415/208.2 |

FOREIGN PATENT DOCUMENTS

| | | | | |
|---|---|---|---|---|
| DE | 19619438 | A1 | | 11/1997 |
| EP | 0844369 | A1 | | 5/1998 |
| EP | 0844369 | A1 | * | 5/1998 |
| EP | 1099826 | A1 | | 5/2001 |
| EP | 1293644 | A1 | | 3/2003 |
| GB | 721453 | A | | 1/1955 |

* cited by examiner

HEAT ACCUMULATION SEGMENT

CROSS REFERENCE TO RELATED APPLICATION

This application is a continuation of International Application No. PCT/EP2006/060900 filed Mar. 21, 2006, which is incorporated by reference as if fully set forth.

FIELD OF INVENTION

The invention relates to a heat accumulation segment for the local separation of a flow duct inside a turbo engine, in particular a gas turbine system, from a stator housing that radially surrounds the flow duct, having two axially opposed joining contoured elements that may respectively be brought into engagement with two components that are axially adjacent along the flow duct.

BACKGROUND

Heat accumulation segments of the type indicated above are parts of axial-flow turbo engines, through which there are flow working media, which are gaseous for the purpose of compression or controlled expansion, and which as a result of their high process temperatures put those system components that are directly acted upon by the hot working media under considerable thermal load. In particular in the turbine stages of gas turbine systems, the rotor blades and guide blades, which are arranged axially one behind the other in rows of rotor blades and guide blades, are directly acted upon by the combustion gases produced in the combustion chamber. To prevent the hot gases that flow through the flow duct from also reaching regions inside the turbo engine that are remotely located from the flow duct, so-called heat accumulation segments that are provided on the stator side, in each case between two rows of guide blades arranged axially adjacent to one another, ensure that there is a bridge-like seal, which is as gas-tight as possible, between the two axially adjacent rows of guide blades.

Heat accumulation segments of corresponding construction may also be provided along the rotor unit. These segments are to be mounted on the rotor side, in each case between two axially adjacent rows of rotor blades, in order to protect regions inside the rotor from excessive heat input.

Although the statements below refer exclusively to heat accumulation segments arranged between two rows of guide blades, and to this extent make it possible to separate the housing on the stator side and the components associated therewith from the flow duct, which is subject to heat load, and to protect them accordingly, it is also conceivable to provide the measures below in a heat accumulation segment that serves to protect entrained rotor components and that is intended for mounting between two rows of rotor blades arranged axially adjacent to one another.

An arrangement of guide blades that is known per se and has an integrated heat accumulation segment can be seen from the partial longitudinal sectional illustration of FIG. 2. FIG. 2 shows a partial longitudinal section through a gas turbine stage in which a flow duct K' is delimited radially internally by a rotor unit 101 and radially externally by a stator unit 102. Rotor blades 103 project radially, in a manner rotationally fixed to the rotor unit 101, into the flow duct K', through which moreover hot gases flow axially in a flow direction oriented as indicated by the arrow.

The flow duct K' is delimited radially externally by guide blades 104 that are mounted on the stator side and whereof the guide blade vanes 141 project radially inward into the flow duct K'. In order to separate the flow duct K' in gas-tight manner from the components mounted on the stator side, the guide blades 104 have a platform 142 which, in the form of a one-part component, covers the axial region directly around the guide blade vane 141 and, in the form of a balcony-like overhang 142', covers the region that bridges two rows of guide blades and radially opposes each of the guide blade tips.

Because the guide blades 104 are arranged in the peripheral direction of the gas turbine, in respective rows of guide blades, the guide blades 104 within a guide blade row that are in each case arranged directly adjacent in the peripheral direction have to be connected to one another in gas-tight manner along their axial side edges 105. To achieve the gas-tight sealing, a tape seal 106 runs over the entire extent of the side edge 105 and opens on either side into corresponding grooves along the side edges of two adjacent guide blades. The tape seal 106 ensures in particular that no cooling air that is supplied to the platform 142 on the stator side can escape into the flow duct K', and therefore corresponding cooling ducts inside the guide blade are available for the effective cooling of all the guide blade regions exposed to the hot gases.

However, everyday operation of gas turbine systems shows that all the components of the gas turbine stage are exposed not only to heat loads but also to mechanical vibrations, as a result of which for example the guide blades 104 are also subjected to tiny radial and axial movements and jolting, and a not inconsiderable result of this is that the tape seals mounted between the guide blades are also weakened. Thus, in the course of mechanical vibrational loads inside the tape seals, cracks and fractures are produced, as a result of which the seals start to become very crumbly. In the event of seal damage of this kind, considerable losses may occur due to leakage between the individual guide blade segments, such that the cooling of the individual guide blades that is required for safe operation cannot be sufficiently guaranteed.

To meet this need, maintenance and inspection work has to be carried out regularly on the guide blades and on the sealants provided in this region. However, this work requires complete rows of guide blades to be dismantled in order ultimately to replace tape seals that are provided between two adjacent guide blades in a guide blade row.

It can be seen, from the joining connection between a guide blade 104 and a stator-side support structure 107 supporting the latter, which can be seen from the longitudinal sectional illustration in FIG. 2, that the guide blade 104 is joined by way of in each case two collar-shaped joining contoured elements 108, 109 that are in engagement with corresponding recesses 110, 111 inside the support structure 107. The individual guide blades 104 can be inserted into the groove-shaped recesses 110, 111 and removed therefrom in the peripheral direction for the purpose of assembly and dismantling. However, if only a single guide blade within a guide blade row is to be inserted into or removed from the arrangement of guide blades, then it is usually necessary for the complete guide blade row or at least segments of the guide blade row to be dismantled.

SUMMARY

The object of the invention is to effectively counter the above-described phenomena of wear that arise as a result of mechanical vibrations at the tape seals that are provided between two guide blades. The intention is to make the maintenance intervals required for the inspection of these seals considerably longer. At the same time, the complexity of the assembly and dismantling that is required for the inspection and where appropriate for the replacement of corresponding sealing materials should be markedly reduced. In particular, it should not be necessary, when removing individual guide blades from the assembly comprising a row of guide blades, to dismantle the entire guide blade row or at least segment regions of the guide blade row.

The present invention is a heat accumulation segment for local separation of a flow duct inside a turbo engine, from a stator housing that radially surrounds the flow duct. The heat accumulation segment includes two axially opposed joining contoured elements that are engagable with two components that are axially adjacent along the flow duct. A first one of the two joining contoured elements has a radially oriented recess with a contoured surface against which a securing pin having an external contour complementary to the contoured surface acts radially under force action from a component that adjoins the first joining contoured element. The first joining contoured element has a collar portion having radially upper and lower collar surfaces, and the collar portion is connected within a counter-contoured receiving contoured element in the axially adjacent component by a joining force that acts between the securing pin and the contoured surface.

BRIEF DESCRIPTION OF THE DRAWINGS

The invention will be described by way of example below, without restricting the general concept of the invention, and by way of exemplary embodiments with reference to the drawing, in which.

DETAILED DESCRIPTION OF THE PREFERRED EMBODIMENTS

Introduction to the Embodiments

Figure 2:
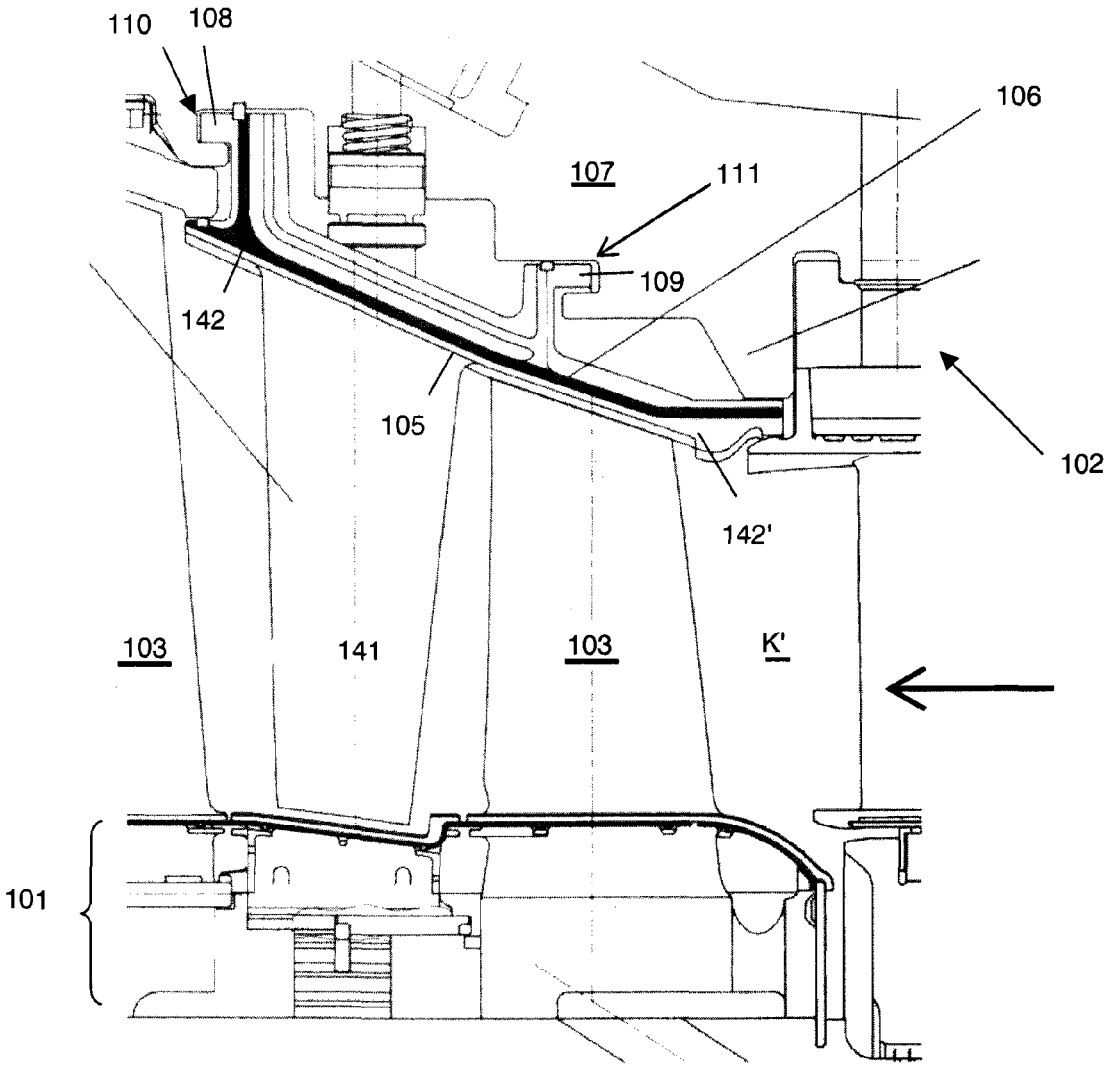
Fig. 2 (Prior Art)
FIG. 2 shows a longitudinal sectional illustration of a guide blade suspension within a gas turbine stage according to the prior art.

The concept underlying the invention takes as its basic starting point separation of the guide blade platform 142 and the balcony-shaped platform section 142', which in accordance with the illustration presented in FIG. 2 are formed in one piece. It is proposed to separate the region that extends axially between two guide blade rows by means of a separate, bridge-like heat accumulation segment, that is to say a heat accumulation segment extends in each case between two axially adjacent guide blades and is delimited, as far as possible in gas-tight manner, on both sides at the guide blades. In the peripheral direction, as many heat accumulation segments are provided as there are guide blades within a guide blade row, and the heat accumulation segments accordingly form a heat accumulation segment row, and the rotor blades of a rotor blade row run in radially internal peripheral manner along the axial extent thereof.

The construction of a heat accumulation segment of this kind as a separate component from the guide blade helps to reduce to a marked extent the damaging effects of the operation-dependent radial and axial jolting of the tape-type sealants that are inserted in each case between peripherally adjacent guide blades, the more so if the axial extent of the respective tape seal is divided in half and runs separately along the side edge of the guide blade platform and the heat accumulation segment.

Moreover, the heat accumulation segment that is constructed as a separate component is to be inserted between two axially adjacent guide blades such that individual guide blades can be removed individually from the assembly comprising a row of guide blades, that is to say without the need to dismantle a complete guide blade row.

A heat accumulation segment of this kind, which in principle serves for local separation of a flow duct inside a turbo engine, in particular a gas turbine system, from a stator housing that radially surrounds the flow duct, and having two axially opposed joining contoured elements that may respectively be brought into engagement with two components that are axially adjacent along the flow duct, such as in particular two guide blades, is constructed in accordance with the invention in that a first one of the two joining contoured elements has a radially oriented recess with a contoured surface against which a securing pin having an external contour acts radially under force action from a component that adjoins the first joining contoured element. Furthermore, the first joining contoured element has a collar portion having a radially upper collar surface and a radially lower collar surface, and the collar portion is connected within a counter-contoured receiving contoured element in the axially adjacent component by a joining force that acts between the securing pin and the contoured surface.

The securing pin preferably has a cylindrical external contour which comes into operative connection with the contoured surface of the recess. This is therefore a so-called cylindrical securing pin which can be pressed flush against a correspondingly inversely-contoured cylindrical contoured surface and ensures a secure fit of the heat accumulation segment against the adjoining component.

The above-described joining connection according to the invention, between a heat accumulation segment and an axially adjoining component of a turbo engine, is suitable in a particularly advantageous manner for use between two guide blades along a gas turbine stage. Although the other embodiments, which are made with reference to the exemplary embodiment, are restricted to a purpose of this kind, the joining connection according to the invention for the heat accumulation segment may equally well be applied between two axially adjacent rotor blades of a rotor unit. For this, the only proper adjustments that are required are construction-dependent and may be carried out by a person skilled in the art.

As is apparent below with reference to the exemplary embodiment presented, the heat accumulation segment according to the invention is detachably and firmly connected to an axially adjacent guide blade by way of only a single joining contour element. A second joining contour element of the heat accumulation segment, which lies axially opposite this joining contour element, is by contrast pressed loosely against a radially oriented joining surface on a stator-side support structure merely under the action of force. If the heat accumulation segment is to be removed, then the guide blade that is in contact with the heat accumulation segment can be separated by way of the loose press connection, merely by removing it axially. The heat accumulation segment may easily be separated from the other guide blade, by contrast, by detaching the joining connection, in that the guide blade concerned is removed from the support structure on the stator side, which supports the guide blade, in the peripheral direction, as a result of which the joining connection to the heat accumulation segment is detached automatically. Because the heat accumulation segment according to the invention is distinguished by particular constructional features relating to the construction of the joint or connection, the heat accumulation segment according to the invention is described below with reference to a preferred exemplary embodiment.

Detailed Description

Figure 1A:
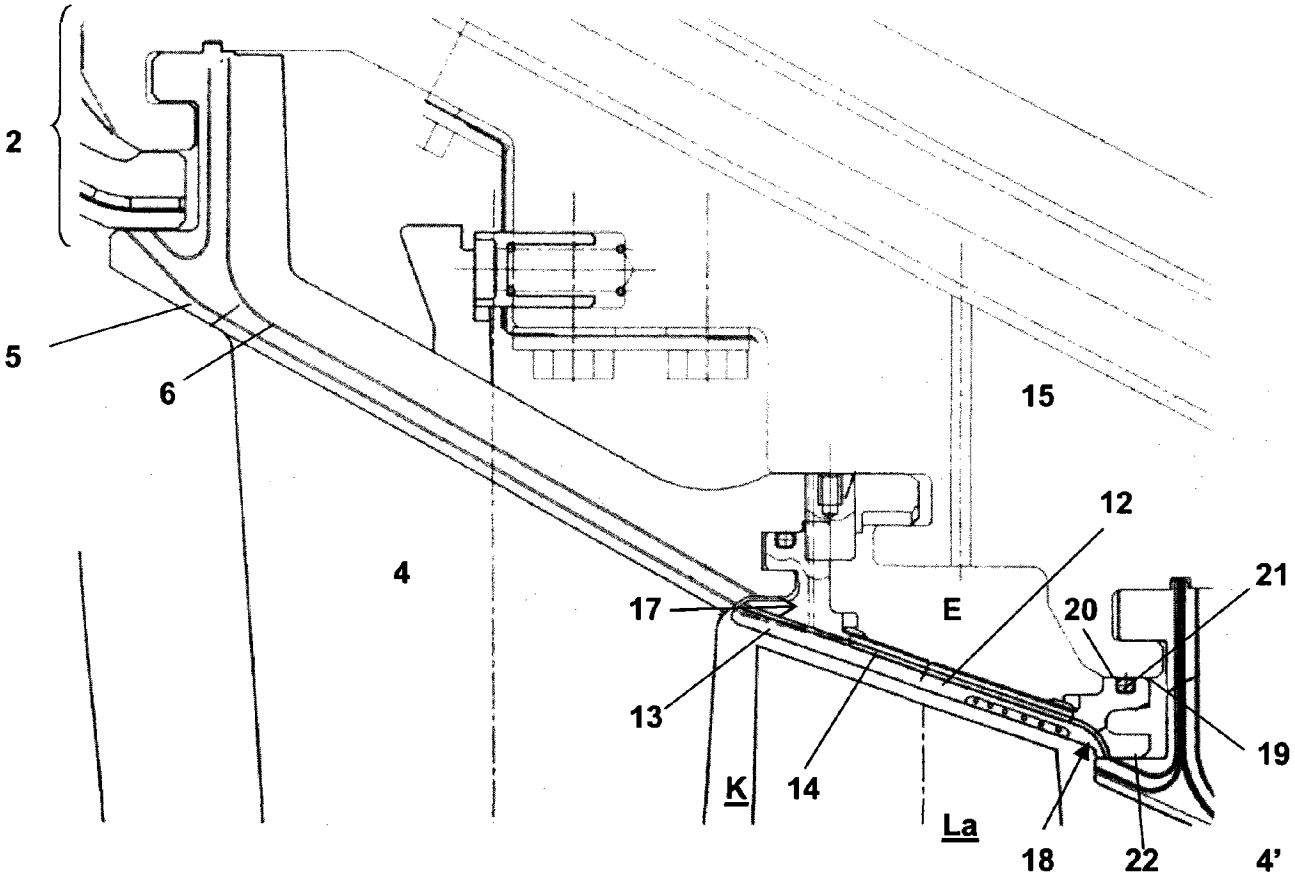
FIG. 1*a* shows a longitudinal sectional illustration through a guide blade heat segment arrangement.

FIG. 1*a* shows a partial longitudinal sectional illustration through the stator-side suspension of a guide blade 4 and a heat accumulation segment 12, the latter being constructed separately from the guide blade 4. As in the exemplary embodiment according to FIG. 2, described above, the guide blade 4 that is illustrated in FIG. 1*a* and the heat accumulation segment 12 axially adjoining it are also capable of separating the flow duct K from the stator-side components 2 in gas-tight manner.

Similarly, running along the side edge 5 of the guide blade 4 and along the side edge 13 of the heat accumulation segment 12 is, in each case, a tape-type sealant 6, 14, and these are in engagement with a heat accumulation segment, which is arranged adjacent in the peripheral direction, and a guide blade respectively, thereby ensuring a gas-tight seal between the flow duct K and the stator-side components 2. In particular, the space E, which is enclosed on the stator side by the heat accumulation segment 12 and is supplied with cooling air by way of a cooling air duct 15, is to be sealed off in largely gas-tight manner from the flow duct K in which in each case rotor blades La rotate axially between adjacent guide blades. Only for the sake of completeness should it be pointed out that the guide blade 4 is also supplied with cooling air. The cooling air supplied in this region is also sealed off from the flow duct K, which is ensured by the tape seal 6.

In contrast to the example described in the background, having a one-piece continuous tape seal, the present invention provides tape seals 6 and 14 of the guide blade and the heat accumulation segment 12, which are each constructed separately. Since they are only half as long, the wear caused by vibrations, which occur as a result of material abrasion, occurs to a markedly lesser extent. This makes it possible to markedly increase the maintenance, and in some cases the replacement, intervals for the tape seal.

In order to reduce the complexity of assembly and dismantling for maintenance work, the heat accumulation segment 12 is constructed separately. The heat accumulation segment 12 has a joining connection, which is constructed according to the invention, with the axially adjacent guide blades, as a result of which it is possible to remove them from the overall assembly of the gas turbine arrangement easily, quickly and in particular individually.

Figure 1B:
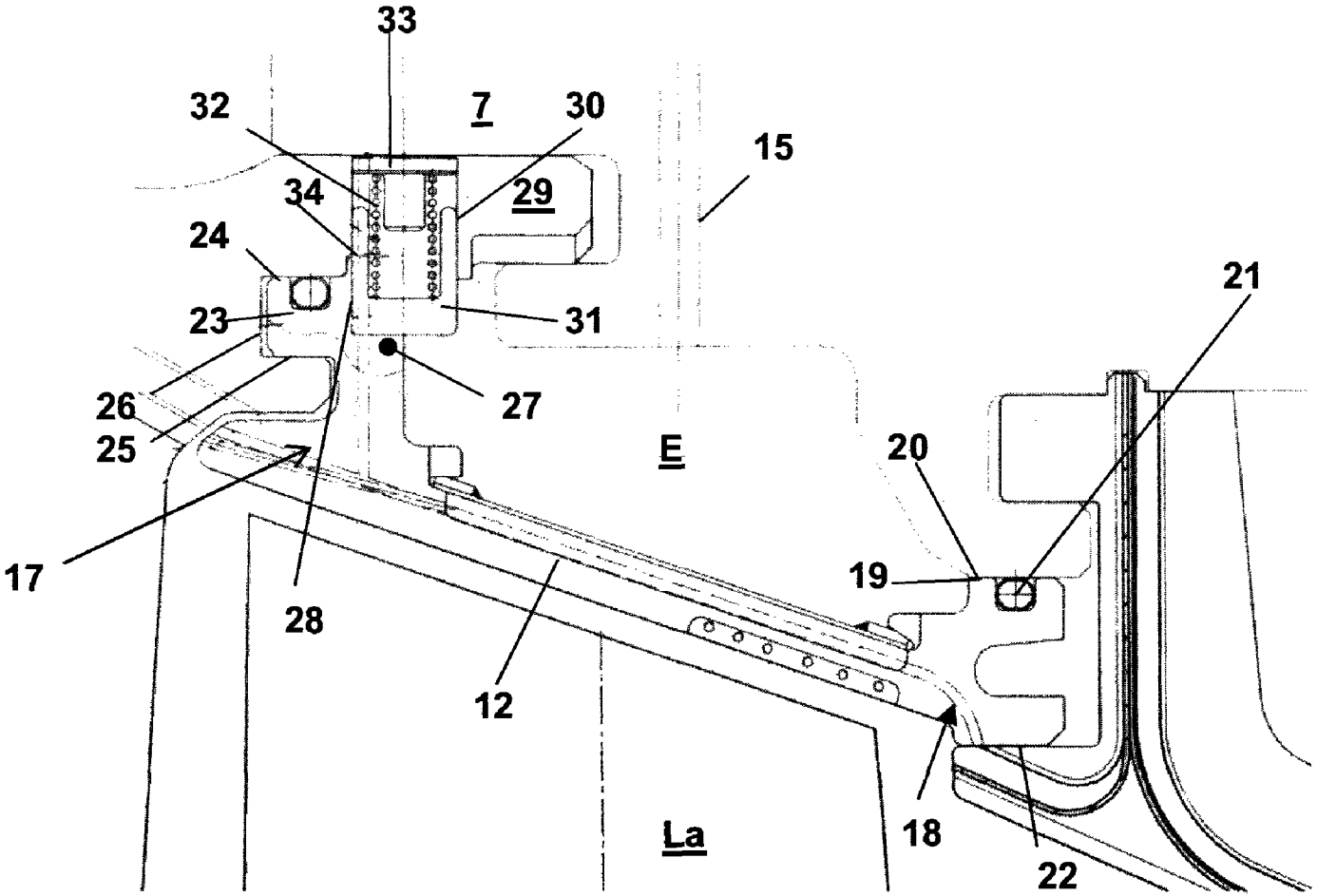
FIG. 1*b* shows a detail illustration of the joining connection.

As a basic requirement, the heat accumulation segment 12 constructed in accordance with the invention has two axially opposed joining contoured elements 17, 18, of which the joining contoured element 18 is pressed against a surface region 20 of the stator-side support structure 7 merely by the action of force through a radially oriented joining surface 19. To separate the internal cooling space E from the flow duct K in gas-tight manner, there is provided inside the radially oriented joining surface 19 a groove-shaped recess inside which a sealant 21 is applied. Furthermore, the second joining contour element 18 adjoins, via a further axial joining surface 22, an axially adjacent guide blade 4', which, when it is to be assembled and dismantled, can be assembled and dismantled only by displacing it axially closer to the heat accumulation segment 12 and moving it axially away therefrom. Provided axially opposite the joining contour element 18 is the first joining contour element 17, which is shown on a larger scale in the illustration presented in FIG. 1*b*. The statements below therefore refer to both FIGS. 1*a* and 1*b*.

The joining contour element 17 of the heat accumulation segment 12 has a collar portion 23 that provides a radially upper and a radially lower collar surface 24, 25. In this arrangement, the collar portion 23 projects axially into a correspondingly counter-contoured receiving contoured element 26 inside the axially adjacent guide blade 4. The connection between the collar portion 23 and the receiving contoured element 26, which to be more precise is provided in the root region of the guide blade 4, is made with precise fit, with the result that the joint or connection has no play or tolerance, at least in the radial direction. This is particularly necessary for a gas-tight press fit, made under the action of force, of the axially opposed joining contoured element 18 against the support structure 7 in the surface region 20.

Directly adjoining the collar portion 23 in the axial direction, the joining contoured element 17 has a radially oriented recess 27 having a cylindrical contoured surface 28. The radially oriented recess 27 has a half shell form, with the cylindrical contoured surface 28 mounted axially facing the collar portion 23.

The joining contour element 17 is additionally covered, radially externally, by an overhanging region 29 of the guide blade 4, and the guide blade 4 is secured in a stator-side support structure 7 by this overhanging region 29. An opening 30 which completely radially penetrates the overhanging region 29 is made in the overhanging region 29 of the guide blade 4, and a cylindrical securing pin 31, a spring element 32 and a screw-type bearing element 33 are provided therein. The securing pin 31 has a cylindrical external contour 34 that comes into engagement with the contoured surface 28 of the first joining contoured element 17 when the securing pin 31 is lowered radially. In the joined condition of the guide blade 4, that is to say as soon as the overhanging region 29 comes into contact with the support structure 7, the bearing element 33 is pressed radially inward in opposition to the spring force of the spring element 32, as a result of which the securing pin 31 is pushed radially inwardly against the cylindrical contoured surface 28 of the radially oriented recess 37. As a result of this, the collar portion 23 of the joining contour element 17 is compressed axially into the recess 26 in the root region of the guide blade 4. This joining connection, which is held exclusively by the spring-loaded securing pin 31, which for its part is secured by the joining connection between the overhanging region 29 and the stator-side support structure 7, produces a stable and yet easily detachable connection between the heat accumulation segment 12 and the axially adjacent guide blade 4.

It is therefore possible to replace the guide blade 4' from a closed gas turbine arrangement in the following way: as already mentioned above, the guide blade 4' may be dismantled by removing it axially. Even with the guide blade 4' removed, the heat accumulation segment 12 remains in its predetermined place, the more so since the heat accumulation segment 12 is kept automatically supported against the root of the guide blade 4 by the joining connection described above in accordance with the invention. Thus, the heat accumulation segment 12 is prevented from slipping axially by the contact between the securing pin 31 and the contoured surface 28 of the joining contour element 11. Similarly, the tolerance-free joining at the upper and lower collar surfaces 24, 25 inside the counter-contoured receiving contoured element 26 ensures that there is sealing under force action in the region of the second joining contour element 18, as described above. The presence of the heat accumulation segment 12 does not hinder re-assembly of the guide blade 4'. Rather, it is possible to bring the guide blade 4' into contact with the second joining contour element 18 by bringing it axially closer in accordance with the movement vector G.

LIST OF REFERENCE NUMERALS

1, 101 Rotor unit
2, 102 Stator unit
3, 103 Rotor blade
4, 104 Guide blade
41, 141 Guide blade vane
42, 142, 142' Guide blade platform
5, 105 Side edge
6, 106 Tape seal, sealant
7, 107 Stator-side support structure
8, 9, 108, 109 Securing collar
10, 11, 110 Stator-side receiving contoured elements
12 Heat accumulation segment
13 Side edge
14 Tape seal, sealant
15 Cooling duct
16 Cooling duct
17 First joining contoured element
18 Second joining contoured element
19 Axially oriented joining surface
20 Surface region
21 Sealant
22 Further axially oriented joining surface
23 Collar portion
24, 25 Radially upper and lower collar surfaces
26 Counter-contoured receiving structure
27 Radially oriented recess
28 Contoured surface
29 Overhanging region of the guide blade
30 Opening
31 Securing pin
32 Spring element
33 Bearing element
34 Cylindrical external contour

What is claimed is:

1. A heat accumulation segment for local separation of a flow duct inside a turbo engine, from a stator housing that radially surrounds the flow duct, the heat accumulation segment comprising two axially opposed joining contoured elements that are engageable with two components that are axially adjacent along the flow duct, a first one of the two joining contoured elements has a radially oriented recess with a contoured surface against which a securing pin having an external contour complementary to the contoured surface acts radially under force action from a component that adjoins the first joining contoured element, and the first joining contoured element has a collar portion, having radially upper and lower collar surfaces, and the collar portion is connected within a counter-contoured receiving contoured element in the axially adjacent component by a joining force that acts between the securing pin and the contoured surface of the heat accumulation segment, wherein the radially oriented recess has a half shell form having half a cylindrical contoured surface, and the half cylindrical contoured surface axially faces the collar portion.

2. The heat accumulation segment as claimed in claim 1, wherein the axially adjacent components are each guide blades, and the first joining contoured element is only in joining connection with the axially adjacent guide blade in a region of a root of the guide blade.

3. The heat accumulation segment as claimed in claim 2, wherein the radially oriented recess has a half shell form having half a cylindrical contoured surface, and the half cylindrical contoured surface axially faces the collar portion.

4. The heat accumulation segment as claimed in claim 2, wherein the external contour of the securing pin, is cylindrical and is engageable with the contoured surface of the recess.

5. The heat accumulation segment as claimed in claim 2, wherein the securing pin has a blind bore radial recess into which a spring element is introduced, the spring element acts radially under a spring force against the cylindrical contoured surface of the radially oriented recess inside a first joining contoured element creating a connection with the securing pin.

6. The heat accumulation segment as claimed in claim 2, wherein a second joining contoured element has an axially oriented joining surface that comprises a sealant and abuts against a surface region of a stator-side support structure, the second joining contoured element arranged as a further axially oriented joining surface that abuts against a surface region of an axially adjacent component such that the adjacent component is displaceable relative to the second joining contoured element only by axial spacing thereof.

7. The heat accumulation segment as claimed in claim 2, further comprising two axially oriented side edges which connect the two axially opposed joining contoured elements, and a sealing tape extending along an entire axial extent of each, the side edges are engageable with a heat accumulation segment that is arranged adjacent to the turbo engine in a peripheral direction.

8. The heat accumulation segment as claimed in claim 2, wherein the adjacent, adjoining component comprises an opening which penetrates a joining region of the component, through which opening the securing pin is inserted the securing pin is guided within the opening so as to be moveable only radially.

9. The heat accumulation segment as claimed in claim 1, wherein the securing pin has a blind bore radial recess into which a spring element is introduced, the spring element acts radially under a spring force against the cylindrical contoured surface of the radially oriented recess inside a first joining contoured element creating a connection with the securing pin.

10. The heat accumulation segment as claimed in claim 1, wherein a second joining contoured element has an axially oriented joining surface that comprises a sealant and abuts against a surface region of a stator-side support structure, the second joining contoured element arranged as a further axially oriented joining surface that abuts against a surface contoured element of an axially adjacent component such that the adjacent component is displaceable relative to the second joining region only by axial spacing thereof.

11. The heat accumulation segment as claimed in claim 1, further comprising two axially oriented side edges which connect the two axially opposed joining contoured elements, and a sealing tape extending along an entire axial extent of each, the side edges are engageable with a heat accumulation segment that is arranged adjacent to the turbo engine in a peripheral direction.

12. The heat accumulation segment as claimed in claim 1, wherein the external contour of the securing pin, is cylindrical and is engageable with the contoured surface of the recess.

13. The heat accumulation segment as claimed in claim 1, wherein the securing pin has a blind bore radial recess into which a spring element is introduced, the spring element acts radially under a spring force against the cylindrical contoured surface of the radially oriented recess inside a first joining contoured element creating a connection with the securing pin.

14. The heat accumulation segment as claimed in claim 13, wherein the spring element is only compressed in the course of joining the axially adjacent component in a joining structure that fixes the component at least locally, thereby generating a spring force as a result of which a radial connection is formed with the securing pin against the cylindrical contoured surface of the radially oriented recess inside the first joining contoured element.

15. The heat accumulation segment as claimed in claim 1, wherein a second joining contoured element has an axially oriented joining surface that comprises a sealant and abuts against a surface region of a stator-side support structure, the second joining contoured element arranged as a further axially oriented joining surface that abuts against a surface region of an axially adjacent component such that the adjacent component is displaceable relative to the second joining contoured element only by axial spacing thereof.

16. The heat accumulation segment as claimed in claim 1, further comprising two axially oriented side edges which connect the two axially opposed joining contoured elements, and a sealing tape extending along an entire axial extent of each, the side edges are engageable with a heat accumulation segment that is arranged adjacent to the turbo engine in a peripheral direction.

17. The heat accumulation segment as claimed in claim 1, wherein the adjacent, adjoining component comprises an opening which penetrates a joining region of the component, through which opening the securing pin is inserted the securing pin is guided within the opening so as to be moveable only radially.

18. A heat accumulation segment for local separation of a flow duct inside a turbo engine, from a stator housing that radially surrounds the flow duct, the heat accumulation segment comprising two axially opposed joining contoured elements that are engageable with two components that are axially adjacent along the flow duct, a first one of the two joining contoured elements has a radially oriented recess with a contoured surface against which a securing pin having an external contour complementary to the contoured surface acts radially under force action from a component that adjoins the first joining contoured element, and the first joining contoured element has a collar portion, having radially upper and lower collar surfaces, and the collar portion is connected within a counter-contoured receiving contoured element in the axially adjacent component by a joining force that acts between the securing pin and the contoured surface of the heat accumulation segment, the radially oriented recess has a half shell form having half a cylindrical contoured surface, the half cylindrical contoured surface axially faces the collar portion, wherein the external contour of the securing pin, is cylindrical and is engageable with the contoured surface of the recess.

* * * * *